United States Patent [19]

Tada

[11] 4,050,273

[45] Sept. 27, 1977

[54] CROSS-ROLL FORGING MACHINE

[75] Inventor: Seiji Tada, Toyama, Japan

[73] Assignee: Sato Tekko Co., Ltd., Toyama, Japan

[21] Appl. No.: 657,988

[22] Filed: Feb. 13, 1976

[30] Foreign Application Priority Data

Feb. 19, 1975 Japan ..... 50-23107

[51] Int. Cl.[2] ..... B21B 27/06; B21D 37/16

[52] U.S. Cl. ..... 72/69; 72/88; 72/200; 72/342

[58] Field of Search ..... 72/69, 88, 108, 200, 72/342

[56] References Cited

U.S. PATENT DOCUMENTS 2,325,479 7/1943 Crawford ..... 72/69 X 2,325,481 7/1943 Crawford ..... 72/69 X 3,686,911 8/1972 Plagermann ..... 72/69

*Primary Examiner*—Robert L. Spicer, Jr.

*Attorney, Agent, or Firm*—Pollock, Vande Sande & Priddy

[57] ABSTRACT

Electric resistance heating means is embedded in a forging tool so that the temperature thereof may be maintained at a desired forging temperature. Therefore the present invention makes it possible to forge light metal alloy workpieces such as aluminum workpieces which have been hitherto considered to be difficult to be forged by rotary forging machines. In addition, better quality of forgings as well as considerable improvement of productivity may be ensured. Thus, reduction of labor and material in a forging process can be attained.

5 Claims, 6 Drawing Figures

CROSS-ROLL FORGING MACHINE

BACKGROUND OF THE INVENTION

The present invention relates to an improvement of cross-roll forging machines, and more particularly of the tool thereof.

The conventional drop hammer and press forging processes have some common problems. Among these are relatively low productivity because of the after-treatment required for removing burrs from forgings, buffing them, etc., and also the large vibrations and noise which are produced during such operations. In order to overcome these problems, in recent years there have been devised cross-roll forging machines in which a pair of forging tools are pressed against a rotating bar and displaced in a direction at right angles to the axis of the rotation of the bar, whereby the bar is drawn and shaped. A cross-roll forging machine has the advantages that the vibrations and noise may be considerably suppressed, the forgings have no burr and have improved strength, waste of material may be minimized, and the automation of forging process is feasible, thus increasing production. Thus remarkable advances have been made in forging techniques by the introduction of cross-roll forging machines.

However, there has been a problem that materials to be forged by cross-roll forging machines are limited because the materials to be forged must be heated in a furnace to a suitable forging temperature prior to the forging process. With steel materials which have high forging temperatures and whose forging temperature range is relatively wide, the rotary forging machines exhibit excellent forging capabilities. On the other hand, in case of light metal alloys such as aluminum alloys, copper alloys, stainless steels and the like with relatively low forging temperatures and with a relatively narrow range of forging temperatures, heat is transmitted from the workpiece to the tools during the forging process so that the temperature of the workpiece drops below its forging temperature. Consequently, it becomes impossible to attain forgings with high quality. To overcome this problem, it has been proposed to heat the forging tools with burners, but this burner heating method is disadvantageous in that the efficiency of forging operations inevitably drops, and soot attaches to the tools, thus resulting in surface defects of the forgings. Also, accurate temperature control is impossible.

Because of these drawbacks, the only alternative has been to use the drop hammer and press forging machines to forge blank materials except steel materials. However, when the temperature of the workpiece drops below the desired forging temperature during the forging process, the workpiece must be removed from the forging machine and recharged into a furnace to be heated again to be desired forging temperature, and then placed again into the forging machine. Such forging steps are laborious and inefficient.

For the sake of explanation, the forging temperatures of some materials are shown in Table I.

Table I

| Materials | Range of temperatures at which workpieces may be forged (° C) |
|---|---|
| Steels | 1,200 to 1,000 |
| Aluminum alloys | 420 to 400 |
| Stainless steel | 1,050 to 950 |

From Table I it is seen that the forging temperatures of steel materials may vary over a relatively wide range. Therefore, during a forging operation with a cross-roll forging machine, the temperature of a steel workpiece may drop within the range from the highest temperature immediately after discharge from the furnace to the lowest allowable forging temperature so that the workpiece may be satisfactorily forged. On the other hand, light metal alloys and the like have low forging temperatures and a critically narrow forging temperature range so that the temperature of a workpiece drops below the lowest allowable forging temperature before the forging operation is completed. As a result, the forgings have poor qualities. Even when the forging tools are heated with burners during the forging operation, the forging efficiency drops, the maintenance of the tool at desired temperature is extremely difficult, and soot attaches to the tools, causing surface defects of the finished workpieces. Therefore the method of heating the forging tools with burners cannot be employed in the process for forging materials with the critical forging temperatures.

SUMMARY OF THE INVENTION

One of the objects of the present invention is therefore to provide a cross-roll forging machine which may produce forgings with high quality from materials with low forging temperatures and with a relatively narrow forging temperature range. To this end, according to the present invention, electrical resistance heating means is embedded in the forging tools so that the tool may be maintained at desired forging temperature during the forging operation.

Another object of the present invention is to provide a cross-roll forging machine in which the dissipation of heat from forging tools may be minimized. To this end, according to the present invention, a large number of grooves is cut and equidistantly spaced apart from each other on the supporting surface of the tool holder so that the flow of heat from the forging tool to the tool holder may be minimized. These grooves are preferably in the form of T in cross-section; that is, T-slots, so that the forging tool mounted on the tool holder may be securely held in position. The number of grooves or T-slots is preferably at least twice as many as the number of T-slots of conventional forging tools required for holding the tool in position.

According to one aspect of the present invention, the electric resistance heating means comprises a plurality of resistance heating elements or wires embedded or otherwise fastened in the tool and electrically connected, preferably, in parallel with each other. One temperature probe means is placed in the tool adjacent to each electrical resistance heating element or wire so that the On-Off operations of the individual heating elements or wires may be controlled in response to the signals from the temperature probes. Therefore, accurate temperature distribution over each forging tool may be attained for precision forging.

BRIEF DESCRIPTION OF THE DRAWINGS

The above and other objects, features and advantages of the present invention will become more apparent from the following description of preferred embodiments thereof taken in conjunction with the accompanying drawing.

DETAILED DESCRIPTION OF THE PREFERRED EMBODIMENT

Figure 1A:
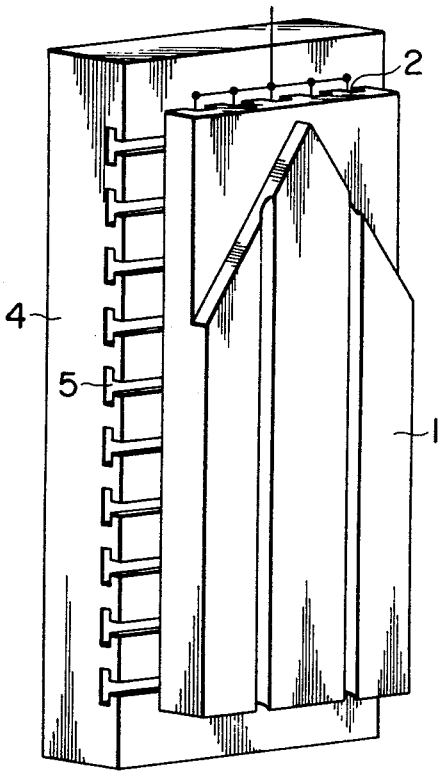
FIG. 1*a* is a perspective view of a forging tool and tool holder of a first embodiment of the present invention which are mounted on a cross-roll forging machine.
Figure 1B:
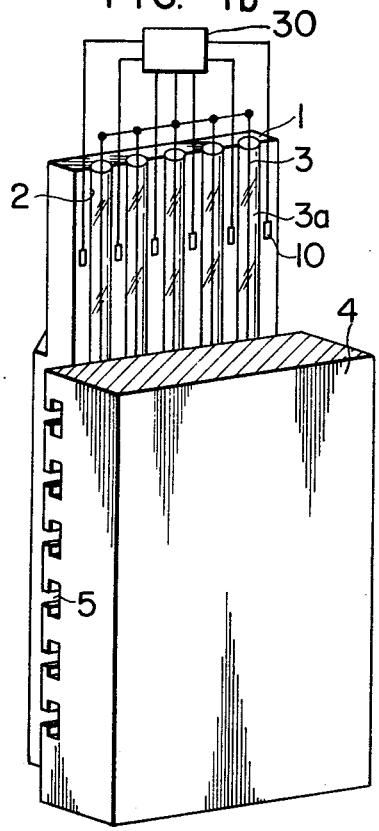
FIG. 1*b* is a perspective view thereof looking in the direction opposite to that of FIG. 1*a*, the upper part of the tool holder being partly cut out to clearly show the rear surface of the forging tool, that is, the surface opposite to the forging surface thereof.

In FIGS. 1*a* and 1*b* there are shown a forging tool 1 and a tool holder 4 in accordance with the present invention for a cross-roll forging machine. The tool 1 has a plurality of grooves 2 which are cut in the rear surface thereof to extend in the longitudinal direction parallel with each other and spaced apart from each other by a suitable distance. Instead of being extended in the longitudinal direction. These grooves may be extended laterally or transversely, and the number of grooves 2 may be suitably selected depending upon the desired temperature and temperature distribution over the forging tool 1.

Insulated electric resistance heating elements or wires 3 are placed in the grooves 2. In the first embodiment, each heating element or wire 3 is enclosed within a quartz tube 3*a*.

On the supporting surface of the tool holder 4, a plurality of T-slots is cut to extend laterally or transversely parallel with each other and spaced apart from each other by a suitable distance. These T-slots 5 have a dual function, that is: (1) securely holding the forging tool 1 in position on the tool holder 4, and (2) providing barriers against heat flow from the tool 1 to the tool holder 4 so that heat dissipation from the tool 1 may be minimized. The number of T-slots is preferably at least twice as many as number of T-slots of the conventional forging tool holders. For instance, whereas a comparable conventional tool holder has T-slots with a pitch of 50 mm, the pitch of the T-slots of the tool holder in accordance with the present invention is reduced at least to 25 mm.

According to the present invention, a plurality of temperature probes 10 is embedded at suitable positions on the rear surface of the tool 1 so that the On-Off control of the resistance heating elements or wires 3 may be controlled individually in response to the temperature distribution in the tool 1 detected by the temperature probes 10. Thus, as will be understood by one skilled in the art, each probe may include a means for open-circuiting the respectively associated element 3 when such probe senses a predetermined temperature. Therefore, the desired temperature distribution over the forging tool 1 may be attained. The On-Off control 30 may be effected by any suitable conventional methods which, for example, control the current flowing through each resistance heating element or wire or the voltage applied across the element or wire 3. For this purpose, the resistance heating elements or wires 3 are preferably connected in parallel, but may be connected in series when precise temperature distribution control is not required. Instead of placing the quartz tubes 3*a* each enclosing the resistance heating element or wire 3 in the grooves 2, they may be extended through holes machined through the forging tool 1.

Figure 2:
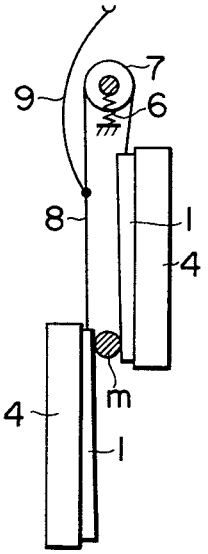
FIGS. 2, 3 and 4 are schematic views used for the steps of the forging operation with the forging tool and tool holder shown in FIGS. 1*a* and 1*b*; *l
Figure 3:
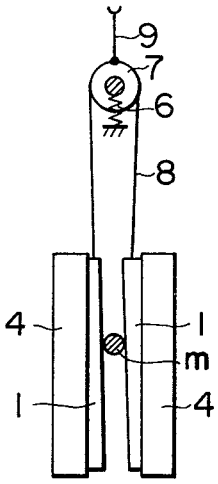
Figure 4:
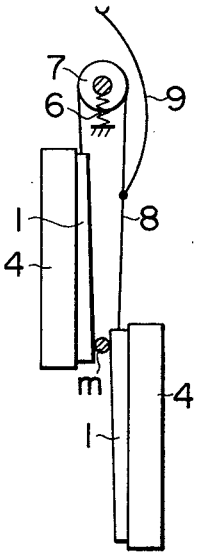

FIGS. 2, 3 and 4 show the forging process with the forging tools 1 and tool holders 4 in accordance with the presdent invention. As is well known to those skilled in the art, on a cross-roll forging machine, one pair of forging tool sets each comprising a tool 1 and a tool holder 4 are so arranged as to coact to forge a workpiece *m*. FIGS. 2, 3 and 4 also show schematically the method and arrangement for feeding electric power to the resistance heating elements or wires 3 mounted on the forging tool 1. Alternatively, any other suitable methods and arrangements may be employed for feeding electric power from the exterior to the resistance heating elements or wires 3 mounted on the forging tools 1 which are vertically reciprocated in opposite directions for forging the workpiece *m*. It should be noted therefore that the present invention is not limited to the electric power feeding arrangement shown in FIGS. 2, 3 and 4. For instance, coiled power cables may be used.

Still referring to FIGS. 2, 3 and 4, a pulley 7 is rotatably disposed above the tools 1, and is biased upwardly by a bias spring 6. A cable 8 is wrapped around the pulley 7 and has its both ends connected to the resistance heating elements or wires 3 on the tools 1. One end of a feed cable 9 is connected to the midpoint of the cable 8 while the other end is connected to a suitable electric power source (not shown).

A control unit 30 for controlling the temperature distribution over the tool 1 may be mounted in the tool 1. However, when the control unit is placed outside of the tools 1, the wires or the like used for transmitting the signals from the temperature probes 10 to the control unit and transmitting the On-Off control signals to the resistance heating elements or wires 3 may be attached to or bundled together with the cables 8 and 9.

When the resistance heating elements or wires 3 are energized, the forging tool 1 is heated to and maintained at a desired temperature. Since many T-slots 5 are cut on the supporting surface of the tool holder 4, the flow of heat from the tool 1 to the tool holder 4 is much retarded, so that the tool 1 may be rapidly heated to the desired temperature and may be maintained at this temperature. Consequently, the workpiece *m* may be kept at a suitable forging temperature from the start to the end of the forging process shown in FIGS. 2, 3 and 4.

Figure 5:
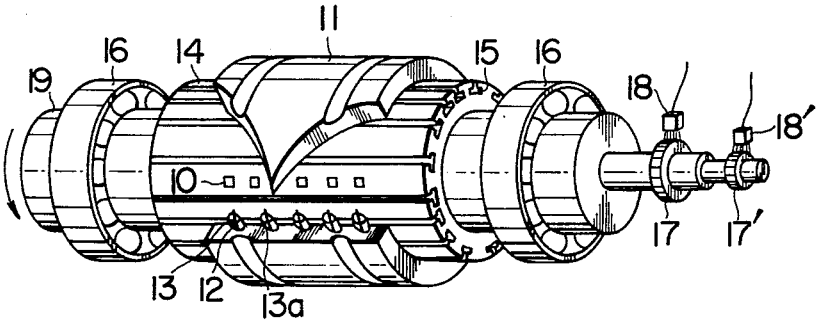
FIG. 5 is a perspective view, partly broken, of a second embodiment of the present invention.*

In the first embodiment, the present invention has been described as being applied to a flat forging tool, but it may be also applied to a cylindrical forging tool as will be described in detail hereinafter as the second embodiment with reference to FIG. 5. Since each of the pair of cylindrical tools is similar in construction, only one of them will be described. As shown in FIG. 5, a cylindrical forging tool 11 is mounted on a cylindrical tool holder 14 rotatably supported by rollers bearings 16. The cylindrical tool 1 rotates in the direction indicated by the arrow while the mating tool (not shown) roates in the opposite direction so that a workpiece is forged while being forced to rotate between them.

On the inner surface of the cylindrical tool 1 a plurality of circumferential grooves 12 is cut parallel with each other and spaced apart from each other by a suitable distance, and insulated resistance heating elements or wires 13 are placed in these grooves 12 and electrically connected to slip rings 17 and 17' which are mounted on the shaft of the tool holder 14 and connected through brushes 18 and 18', respectively, to a suitable electric power supply (not shown)

As in the case of the first embodiment, over the surface of the tool holder 14 a plurality of T-slots is cut to extend in the axial direction and spaced apart from each other by a suitable distance. These T-slots 15 have the dual function of securely holding the cylindrical tool 11 in position and providing barriers against the flow of heat from the tool 11 to the tool holder 14. Therefore, as in the case of the first embodiment, the number of T-slots 15 must be at least twice as many as the number of T-slots required for holding the tool 11 over the tool holder 14. When the tool 11 is needed to be heated uniformly, the On-Off control of the resistance heating elements or wires 13 is carried out in response to a signal from one temperature probe placed for measuring the temperature of the tool 11. However, when the temperature distribution with the temperature gradient or the local heating of the tool 11 is required, the resistance heating elements or wires 13 are connected in parallel and a temperature probe 20 is placed adjacent to each heating element or wire 13 so that the On-Off control of the individual heating elements or wires 13 may be effected in response to the signals from the temperature probes 20.

It is to be understood that the present invention is not limited to the above two preferred embodiments and that various modifications may be effected within the spirit and scope of the present invention. For instance, even though the present invention has been described in conjunction with tools adapted for forging aluminum workpieces, the present invention may be also applied to the dies used for forging steel workpieces. Since the steel workpieces may be kept at suitable forging temperatures by the tools in accordance with the present invention, the production variances of forgings produced in accordance with the prior art technology may be reduced.

I claim:

1. In a cross-roll forging machine of the type comprising means for firmly gripping and rotating a cylindrical workpiece, a pair of holders each adapted to move in opposed relation in a direction transverse to the axis of said cylindrical workpiece and a pair of forging tools mounted on said tool holders, respectively, for forging said workpiece into a desired shape, the improvement comprising a. electric resistance heating means embedded in each of said forging tools for heating the same, b. control means for controlling the amount of heat applied by said heating means to said forging tools to control the temperature distribution over each of said forging tools, and c. a plurality of grooves cut and equidistantly spaced apart from each other of the supporting surface of each of said tool holders.

2. The improvement as set forth in claim 1 wherein said grooves are T-slots which are spaced apart from each other by a distance of 25 millimeters or less.

3. The improvement as set forth in claim 1 wherein said electric resistance heating means comprises a plurality of electric resistance heating elements or wires placed in said tool and electrically connected in parallel with each other, and said control means comprises a plurality of temperature probes, embedded in said tool each being adjacent to each of said electric resistance elements, and means adapted to control the feed of current flowing through said resistance heating elements in response to the signals from said temperature probes.

4. The improvement as set forth in claim 1 wherein said tools are flat tools mounted on the tool holders which make rectilinear movement.

5. The improvement as set forth in claim 1 wherein said tools are cylindrical tools mounted around the surface of cylindrical tool holders which rotate about their axes parallel with the axis of said workpiece.

* * * * *